United States Patent [19]

Omizono et al.

[11] Patent Number: 4,837,995

[45] Date of Patent: Jun. 13, 1989

[54] ANCHORING DEVICE FOR A TENSION MEMBER OF PRESTRESSED CONCRETE

[75] Inventors: Hitoshi Omizono, Tokyo; Hiroshi Sasaki; Yasuo Fukatsu, both of Omiya; Saburo Ota, Tokyo; Yoshio Ueda, Suzuka, all of Japan

[73] Assignees: Mitsubishi Mining and Cement Co., Ltd.; Kimpo Electronics Co., Ltd., both of Tokyo, Japan

[21] Appl. No.: 50,251

[22] Filed: May 13, 1987

[51] Int. Cl.[4] ..... E04C 5/12; E04C 5/07; B29C 43/20

[52] U.S. Cl. ..... 52/223 L; 52/230; 264/258

[58] Field of Search ..... 249/46, 213; 264/228, 264/229, 257, 258; 52/223 L, 230, 223 R; 24/122.6; 403/367, 373, 374

[56] References Cited

U.S. PATENT DOCUMENTS

| | | | |
|---|---|---|---|
| 3,975,479 | 8/1976 | McClean | 264/257 |
| 3,981,504 | 9/1976 | Gugel | 264/DIG. 83 |
| 4,000,623 | 1/1977 | Meardi | 52/230 |
| 4,121,395 | 10/1978 | Rudolf | 52/230 |
| 4,330,494 | 5/1982 | Iwata | 264/257 |
| 4,367,568 | 1/1983 | Weiser | 52/230 |
| 4,376,749 | 3/1983 | Woelfel | 264/258 |
| 4,532,169 | 7/1985 | Carley | 264/258 |
| 4,649,080 | 3/1987 | Fischer | 264/258 |
| 4,671,034 | 6/1987 | Rehm | 52/223 L |

OTHER PUBLICATIONS

Handbook of Prestress Concrete, pp. 107 and 108.

*Primary Examiner*—James Lowe
*Assistant Examiner*—Jeremiah F. Durkin, II
*Attorney, Agent, or Firm*—Frank J. Jordan; C. Bruce Hamburg; Manabu Kanesaka

[57] ABSTRACT

An anchoring device for prestressed concrete. The anchor is made of an outer member which has an inner hole with a cone shaped surface and an inner member which is made up of a plurality of wedges having at least one hole for holding a tension member. Both the inner member and the outer member are made by alternately superposing cloths of glass fibers and carbon fibers; impregnating the cloths with a resin and curing the resin.

11 Claims, 2 Drawing Sheets

ANCHORING DEVICE FOR A TENSION MEMBER OF PRESTRESSED CONCRETE

FIELD OF THE INVENTION AND RELATED ART STATEMENT

This invention relates to a fixture for a prestressed concrete, and more particularly to an anchoring device for a tension wire or rod of a prestressed concrete which is improved so as to possess notably enhanced corrosion-proofness and durability.

As widely known, the prestressed concrete is a concrete product which has a compressive load applied in advance thereto.

As a means of applying the compressive load to a concrete, there is prevailing a method which comprises forming through holes in the longitudinal direction in the concrete, inserting wires or bars of steel, for example, through the through holes, imparting tension to the wires, and thereafter fastening the opposite ends of the wires to the opposite ends of the concrete with the aid of fixtures.

The structures or constructions of these fixtures are greatly varied in kind. Since they require high strength, steel is extensively utilized as the material therefor.

The fixtures made of steel retain durability fairly in a normal working environment. In a highly corrosive environment, however, they gather rust and suffer degeneration of their own strength. The rust so produced accelerates deterioration of the portions of concrete directly surrounding the coats of rust growing on the fixtures. (For example, since the fixtures undergo a voluminal expansion during the growth of this rust, the voluminal expansion inevitably causes the concrete to sustain fine cracks.)

When the conventional prestressed concrete is used in marine structures or structures located near seashores, therefore, it is liable to entail the drawback of relatively quickly losing the internal stress.

As one measure for relief from the drawback, adoption of fixtures made of stainless steel has been conceived to materialize notable improvement in durability. These fixtures of improved durability, however, betray their lack of sufficient corrosion-proofness in environments susceptible of the adverse actions of salt sea breeze.

OBJECT AND SUMMARY OF THE INVENTION

An object of this invention is to provide a fixture for prestressed concrete which possesses extremely high strength and excels in corrosion-proofness.

Another object of this invention is to provide a fixture for prestressed concrete which can be stably used for a long time even in a highly corrosive environment.

The fixture of the present invention for prestressed concrete is produced by combining a thermosetting synthetic resin as a binder and glass fibers or carbon fibers as reinforcing fibers and molding the resulting mixture.

DESCRIPTION OF THE PREFERRED EMBODIMENTS

Now, the present invention will be described more specifically below.

Desirably the thermosetting synthetic resin usable in the present invention yields sparingly to deformation due to external stress and excels in weatherability and chemical resistance. As concrete examples of the thermosetting synthetic resin answering the description, there can be cited epoxy acrylate resin, phenol resin, amino resin, and polyester resin.

As reinforcing fibers, there are used glass fibers and carbon fibers.

Suitably, the glass fibers have diameters approximately in the range of 10 to 20 μm. In terms of form, they may be a roving or chopped strands.

The carbon fibers suitably have diameters approximately in the range of 5 to 10 μm. In terms of linear dimension, they may be short-staple fibers or long-staple fibers which is selected due to the occasion.

If the glass fibers and the carbon fibers have diameters smaller than the respective ranges mentioned above, they cost much. If they have diameters larger than the ranges, they are deficient in flexibility. If they have lengths greater than the respective ranges mentioned above, it tends to intertwine during the course of production and renders homogeneous distribution in the mixture less easy. If they have lengths smaller than the ranges, they produces an insufficient reinforcing effect.

The ratio of the glass fibers to the carbon fibers is desired to fall approximately in the range of 2:1 to 1:1. The ratio of the total amount of the glass fibers and the carbon fibers to the amount of the aforementioned thermosetting synthetic resin desirably falls approximately in the range of 85:15 to 60:40. When the mixing ratio is selected in this range, the shaped article of resin consequently obtained is allowed to acquire very high strength.

The present invention tolerates the thermosetting synthetic resin incorporating therein pigment and powdered filler to the extent of not impairing strength thereof.

Figure 1:
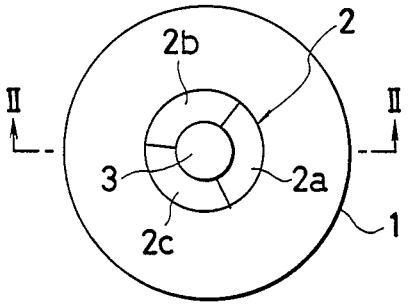
FIG. 1 is a plan view illustrating a typical fixture contemplated by the present invention.
Figure 2:
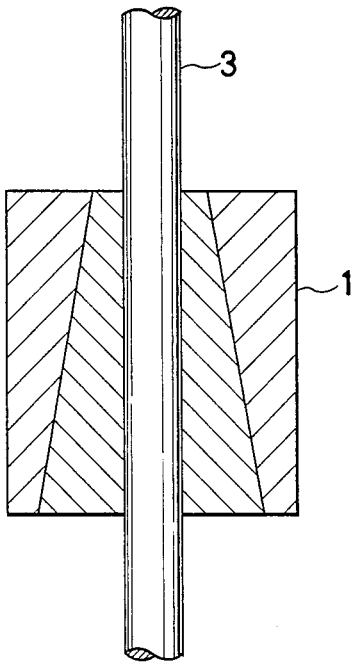
FIG. 2 is a cross section taken along the line II—II in FIG. 1.

One concrete example of the fixture to which the present invention can be applied is illustrated in FIG. 1 and FIG. 2. In FIG. 1 and FIG. 2, the reference numeral 1 denotes an outer cone possessing a tapered inner hole. The reference numeral 2 denotes an inner cone of the shape of a truncated cone fitting in the inner hole. This inner cone 2 possesses a central hole of a uniform diameter. The inner cone 2 is equally divided into three wedges 2*a*, 2*b*, and 2*c*. A wire 3 is inserted through the central hole of the inner cone 2. Slipping possibility of the wire 3 in the central hole is prevented by the tightening force of the wedges 2*a*, 2*b*, and 2*c*. Thus, the wire is secured in place.

Figure 3:
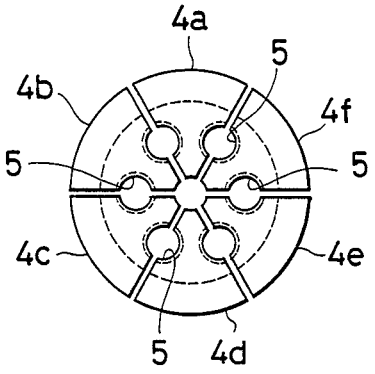
FIG. 3 is a plan view illustrating another typical fixture according to the present invention.
Figure 4:
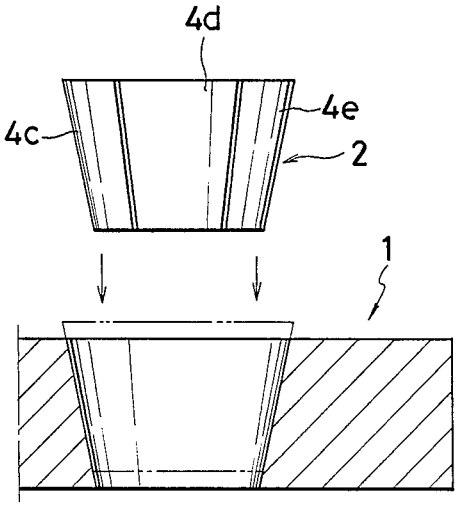
FIG. 4 is a side view of the fixture of FIG. 3.

The present invention can also be applied to a fixture of the kind illustrated in FIG. 3 and FIG. 4. FIG. 3 is a plan view illustrating an inner cone of the fixture for allowing seven wires to pass and to be held therein. In this fixture, the inner cone is divided equally into six wedges 4*a* through 4*f*. Grooves for passing wires are dug into the adjoining surfaces of these wedges. The wires are passed through these grooves 5 and the central hole of the inner cone and secured in place.

This fixture is fitted in the outer cone 1 as illustrated in FIG. 4.

In addition to the fixtures constructed as illustrated in the diagrams, the present invention can be applied to various fixtures such as those proposed by Hochtief, Bilfinger, Held u. Franke, Moraudi, and Bauwens in the Handbook of Prestress Concrete.

The shaped article of resin contemplated by this invention can be produced by any of the conventional methods. For example, it can be easily produced by the filament winding method. Alternately, it may be obtained by alternately superposing cloths of glass fibers and cloths of carbon fibers, impregnating the resulting pile with the thermosetting synthetic resin, and molding the impregnated pile. When this molding is effected by the compression molding technique, the shaped article consequently obtained is allowed to acquire notably high strength.

Further, when the shaped article is obtained by the lamination technique using cloths of fibers, the surfaces of the fixture for contact with the bracing wires have a pattern of superposed cloths and exhibit a very high coefficient of friction, making the prevention of slip of wires all the more certain.

Now, the fixture of the present invention will be described below with reference to working examples.

The fixture illustrated in FIG. 1 and FIG. 2 was manufactured by the following procedure.

PRODUCTION OF OUTER CONE

With a stirrer, 20 parts of epoxy acrylate resin (produced by Showa Highpolymer Co., Ltd. and marketed under trademark designation of Riboxy), 0.2 part of a curing agent, 1 part of pigment, 1 part of silica (invariably by weight) were stirred. In a filament winding machine, 50 parts of glass fibers and 30 parts of carbon fibers were impregnated with the aforementioned resin mixture and wound in a roll until a fixed thickness. The resultant roll was removed from the winding machine and then left standing in a constant temperature bath at 100° to 110° C. for one hour and in another constant temperature bath at 150° to 160° C. for three hours to be solidified. The hard cylinder consequently obtained roughly measured 40 mm in outside diameter, 60 mm in length, and 16 mm in smallest inner diameter. The inner hole had an inclination of 15°.

PRODUCTION OF INNER CONE

With a stirrer, 20 parts of epoxy acrylate resin (produced by Showa Highpolymer Co., Ltd. and marketed under trademark designation of Riboxy), 0.2 part of a curing agent, 1 part of pigment, 30 parts of calcium carbonate, and 0.5 part of magnesium oxide (invariably by weight) were stirred. A cloth of glass fibers and a cloth of carbon fibers were impregnated with the resin mixture obtained above and left standing in a constant temperature bath at 40° C. for 24 hours to produce prepregs having a fiber content of about 50%. The prepregs were cut in a prescribed size. The cut cloths of glass fibers and those of carbon fibers were alternately superposed. The pile was placed in a mold and pressed therein at 150° to 170° C. for three minutes to be solidified.

The fixture obtained in this case, when wires secured therein were drawn, showed breaking strength exceeding 10 tons.

As is clear from the foregoing description, the fixture of the present invention possesses higher strength and far better durability than the conventional fixture made of steel.

In marine structures and structures installed near seashores which are inevitably exposed to a highly corrosive environment, therefore, the fixture of this invention can be stably used for a very long period.

What is claimed is:

1. An anchoring device for securely fixing end portions of a tension member to a concrete to provide prestressed concrete, comprising, an outer member having an inner hole with an internal cone shaped surface, said outer member being formed by alternately superposing cloths of glass fibers and carbon fibers, impregnating the cloths of glass fibers and carbon fibers with a thermosetting synthetic resin, and solidifying the resin, and an inner member with an external cone shaped surface to be situated in the inner hole of the outer member, said inner member being formed of a plurality of wedges and having at least one hole for frictionally holding the tension member, each wedge of the inner member being formed by separately impregnating a cloth of glass fibers and a cloth of carbon fibers with a thermosetting synthetic resin to prepare prepregs, cutting the prepregs to a desired size, alternately superposing the prepregs of glass fibers and carbon fibers, and press-molding the prepregs to thereby form the wedge.

2. The anchoring device according to claim 1, wherein said thermosetting synthetic resin is one member selected from the group consisting of epoxy acrylate resin, phenol resin, amino resin, and polyester resin.

3. The anchoring device according to claim 1, wherein said glass fibers have diameters in the range of 10 to 20 μm.

4. The anchoring device according to claim 1, wherein said carbon fibers have diameters in the range of 5 to 10 μm.

5. The anchoring device according to claim 1, wherein the ratio of said glass fibers to said carbon fibers falls in the range of 2:1 to 1:1 by weight.

6. The anchoring device according to claim 1, wherein the ratio of said reinforcing fibers to said thermosetting synthetic resin is in the range of 85:15 to 60:40 by weight.

7. The anchoring device according to claim 1, wherein said molding is effected by the filament winding technique.

8. An anchoring device according to claim 1, wherein said prepreg has a fiber content of about 50%.

9. An anchoring device according to claim 8, wherein said outer member has a cylindrical outer surface.

10. An anchoring device according to claim 1, wherein said external cone shaped surface of the inner member corresponds to the internal cone shaped surface of the outer member, said hole of the inner member having a constant diameter so that when tension is applied to the tension member, the wedges are pulled in the direction to reduce the diameter of the hole of the inner member to thereby securely hold the tension member to the outer member by means of the wedges.

11. An anchoring device according to claim 10, wherein said inner member has a plurality of holes symmetrically arranged in the center thereof.

* * * * *